United States Patent [19]

Smith

[11] 4,154,014

[45] May 15, 1979

[54] MAGNETICALLY ACTUABLE SAFETY APPARATUS FOR PREVENTING UNAUTHORIZED ACTUATION OF A TOUCH-OPERABLE DEVICE

[76] Inventor: Joseph E. Smith, 170 Locksunart Way, Apartment 23, Sunnyvale, Calif. 94087

[21] Appl. No.: 781,007

[22] Filed: Mar. 24, 1977

[51] Int. Cl.[2] ..... F41C 17/08

[52] U.S. Cl. ..... 42/70 R; 42/1 MH; 42/66; 42/70 E

[58] Field of Search ..... 42/70 R, 70 E, 70 F, 42/1 MH, 1 LP, 66

[56] References Cited

U.S. PATENT DOCUMENTS

| | | | |
|---|---|---|---|
| 3,978,604 | 9/1976 | Smith | 42/1 MH |
| 4,067,132 | 1/1978 | Smith | 42/1 MH |

*Primary Examiner*—Charles T. Jordan
*Attorney, Agent, or Firm*—Richard Alan Brown

[57] ABSTRACT

An apparatus for selectively blocking movement of a part of a device employing said apparatus which is particularly useful in preventing the unauthorized firing of a weapon or removal of screw caps or operation of other touch actuated devices. The apparatus typically comprises a magnetically actuable member mounted to a resilient material which material is mounted to the device for selectively disposing the magnetically actuable member in a conflicting relationship for blocking movement of the part. Magnetic means is provided from without the device and juxtaposed the magnetically-actuable member for attracting or repelling the member out of the blocking relationship with the part whereby the part is free to move.

14 Claims, 9 Drawing Figures

MAGNETICALLY ACTUABLE SAFETY APPARATUS FOR PREVENTING UNAUTHORIZED ACTUATION OF A TOUCH-OPERABLE DEVICE

BACKGROUND OF THE INVENTION

1. Field of the Invention

There is a well-recognized need to prevent, for example, the undesired firing of a firearm, the undesired operation of touch-operable devices, the undesired operation of power tools or the like, or the undesired opening of various containers. A simple device is desirable which would prevent other than the owner from operating a device. Also, it would be useful to have a protective mechanism which would prevent accidental firing or any unauthorized use of touch-actuated device or unauthorized opening of containers. Thus, the present invention relates to a magnetic apparatus for selectively blocking movement of a part in a device. In particular, the present invention relates to a magnetic apparatus for inhibiting operation of an actuable device.

2. Prior Art

Magnetic devices, per se, are known in the art. Reference is made to U.S. Pat. Nos. 2,548,581; 3,493,902; 3,571,544; 3,801,767; and 3,944,762. The devices taught by these patents generally disclose magnetic safety or switching mechanisms. Also, reference is made to my U.S. Pat. No. 3,978,604 entitled Trigger Inhibiting Mechanism and my pending application Ser. No. 670,937 filed Mar. 26, 1976, now U.S. Pat. No. 4,067,132 entitled Safety Device for Preventing the Unauthorized Firing of a Weapon.

SUMMARY OF THE INVENTION

In accordance with the present invention, an apparatus is provided for selectively blocking movement of a part of a touch-operable device employing the apparatus, which apparatus comprises a resilient member having a first end secured to the device, a magnetically actuable member disposed on the second end of the resilient member in a conflicting relationship with said part for blocking such movement of the part. Biasing is provided from without the device and juxtaposed the magnetic actuable member for disposing the magnetically actuable member out of the blocking relationship with the part of the device employing the apparatus whereby the part is free to move.

A feature of the present invention resides in the provision of a safety mechanism, simple in construction and reliable in operation, which has exemplary application in inhibiting operation of a trigger-actuated mechanism, or other touch-operable devices including container lid devices.

A more specific feature of the present invention resides in the provision of a magnetically-actuable member attached to a resilient material or arm wherein the material or arm bends into or out of conflicting relationship with a movable part of a device in which the present invention is employed. The magnetically actuable member is normally positioned in conflicting relationship with the movable part by means of the resilient arm, wherein, for example, the arm is formed from a spring or the like, and is moved out of this conflicting relationship by magnetic forces created when a magnet is brought into close proximity with the magnetically actuable member. If the magnet is subsequently removed the resilient arm will return the member to the preferred conflicting relationship.

In accordance with the embodiments of the present invention, a magnet from without the device employing the present invention is polarized so as to either attract or repel the magnetically actuable member out of the conflicting relationship. Preferrably, the magnet force is stronger than the biasing means or the resiliency of the spring or arm to thereby overcome positioning forces of the resilient arm, the spring or other bias means.

A distinct advantage of this invention is the simplicity of construction and reliability of operation. Thus, the apparatus of this invention can be used as a means for inhibiting operation of a trigger-actuated mechanism such as a weapon, a toy pistol, or the like, or such things as touch-operable pressurized containers or other touch-operable mechanisms. Also, the present invention can selectively inhibit the opening of containers by removal of lifting of the lid or cap.

DETAILED DESCRIPTION

Figure 1:
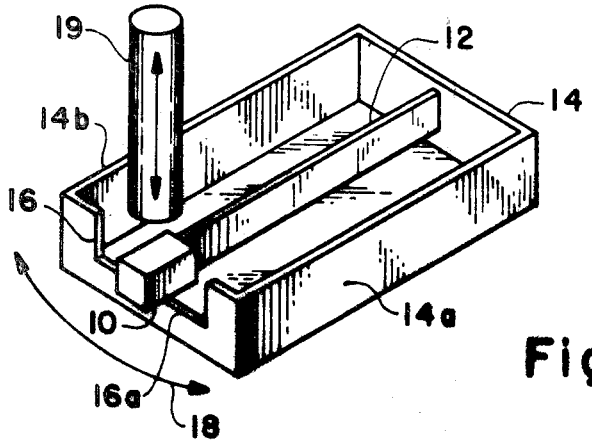
FIG. 1 illustrates the basic principle of operation of the present invention.

Referring now to the drawings, and in particular to FIG. 1, a diagram of a basic mechanism illustrating the principle of operation of the present invention is shown. A magnetically actuable member 10 is mounted on one end of a resilient member 12, which may comprise, for example, a spring or the like. The other end of the resilient member 12 is mounted on one end of a support housing 14. The opposite end of the housing 14 has formed therein a recessed area 16 which allows movement along an arcuate path of the magnetically actuable member 10 in a direction generally indicated by the arrow 18. Preferably, the resilient member 12 maintains the magnetically actuable member 10 substantially parallel with the center line of the housing 14 and substantially within the center of the opening 16. If a magnetic force is brought in close proximity to either side 14*a* or 14*b* of the housing 14, the magnetically actuable member 10 will deflect in a direction depending upon the polarization of magnetic forces applied. The resilient member 12 acts as a means for biasing the magnetically actuable member 10 substantially within the center of the opening 16. It is noted, however, that magnetic forces need not be applied perpendicular to sides 14*a* and 14*b* of the housing 14, but may also be applied at any oblique angle to the magnetically actuable member 10 so as to deflect this member.

A moveable part 19 of a larger device in which the apparatus of the present invention is employed, moves in a direction as indicated by the overdrawn arrow on this member. Movement of the part 19 towards the magnetically actuable member 10 will be blocked by this member when the resilient member 12 is aligned substantially parallel with the center line of the housing 14. Edge 16*a* of the opening 16 acts as a backstop or support for the member 10 when a force is applied thereon by movement of the part 19. If, for example, a magnetic force (not shown) is brought into close proximity with the member 10 thereby deflecting the member (either in an attraction or repelling mode) the member 10 will be deflected to one side or the other of the path of travel of the part 19. Accordingly, the part 19 is free to move in the direction indicated by the overlying arrow. When the magnetic forces are removed from close proximity with the member 10, the resilient forces of the member 12 returns the magnetically-actuable member 10 to a position in conflicting relationship with movement of the part 19 when the part 19 has returned back to a position as illustrated in FIG. 1. It is noted that the magnetically actuable member 10 may comprise a magnet in an attractiing or repelling mode, a housing containing a magnet therein in an attracting or repelling mode or a ferruginous material in the attraction mode. Further, it is noted the magnetic force (not shown) may comprise a permanently magnetized material, such as a magnet contained within a ring, or the like.

The housing 14 is conveniently formed of a metal or plastic and preferably formed of a non-magnetically attractable material. Accordingly, in the preferred embodiment no magnetic forces from the housing 14 will act on the member 10 when the member 10 is in the neutral position or when the member 10 is returning to the neutral position from a deflected position. If, for example, member 10 were formed from a magnet and the housing 14 contained a magnetic material, movement of the member 10 would be eratic or interfered with by magnetic forces set up between the member 10 and the housing 14.

Figure 2:
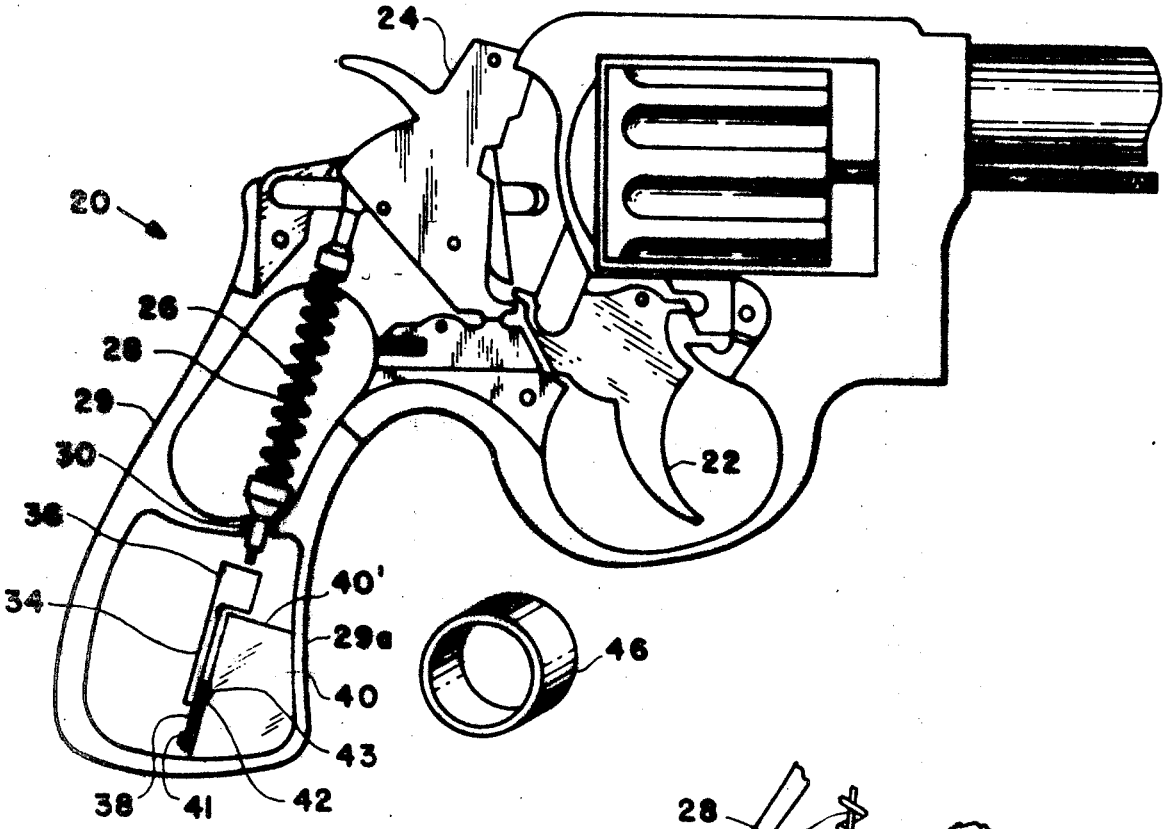
FIG. 2 illustrates a side elevation view of a weapon device employing one embodiment of the present invention.

Referring now to FIG. 2, an example of a specific application of the present invention is illustrated in a weapon 20. Reference is made to my copending application Ser. No. 670,937, filed Mar. 26, 1976, now U.S. Pat. No. 4,067,132, and entitled Safety Device for Preventing the Unauthorized Firing of a Weapon for a detailed description of the weapon 20. Briefly, the weapon 20 includes a trigger 22 and a hammer 24 operated by compression spring 26. A shaft or rod 28 within a handle-grip frame 29 of the weapon is biased by the spring 26 against the hammer 24 and is slidable in a track 30 directing rod movement approximately along the maximum length of the handle-frame 29 in response to hammer rotation. A magnetically actuable member 34 is located in blocking relationship with a shaft or rod 28, which prevents movement of the hammer 24.

The member 34 includes a confronting head restrictor 36 disposed in the path of movement of the bar or rod 28 to inhibit movement of the bar or rod sufficiently enough so as to release the hammer 24, thereby inhibiting firing of the weapon. Preferably, the rod or shaft 28 does not touch the confronting head restrictor 36 of the member 34 in the normal confronting position. This arrangement is preferable so as to avoid frictional resistence between the restrictor head 36 and the rod 28 which would interfere with movement of the member 34. The member 34 is maintained in a conflicting position so as to maintain the restrictor head 36 in a conflicting relationship with the shaft or rod 28 by means of a resilient member 38 which, for example, may be a leaf spring or the like. The resilient member 38 may be mounted to the handle grip frame 29. However, in the embodiment illustrated in FIG. 2 the resilient member 38 in the form of a leaf spring is secured to a support block 40 by means of a pin 41. The block 40 is contained within the handle grip frame 29 and the block is preferably formed a non-magnetically attractable material (non-ferrogeneous material) so as not to interfere with movement of the magnetically actuable member 34 as described hereinabove. In addition, surface 40' of the block 40 acts as a backstop or support for the restrictor head 36 when a force is exerted thereon by means of the rod or shaft 28. An additional pin 42, while not required, may be disposed at the juncture between resilient member 38 and the magnetically actuable member 34 which is received by an indent or recess 43 in the block 40 to stop the member 34 from further forward travel after deflection of this member 34 to be described in greater detail hereinbelow.

In operation, the magnetically actuable member 34 is biased by means of the resilient member 38 to a position blocking the translation of the part 28 coupled to the hammer 24, thereby preventing the hammer from substantial rotational movement and spring release. Thus, the hammer neither can be hand-cocked for single-action firing nor trigger-released as in double-action firing. To release the safety device of the present invention and allow the hammer to release and discharge the firearm, a magnetic means 46 is brought into close proximity with the edge 29*a* of the handle 29 of the weapon 20. The magnetic means 46 can comprise, for example, a ring containing a magnet, which is worn on the finger of the gun-gripping hand by the user of the weapon. Magnetic forces from means 46 cause the magnetically actuable member 34 to deflect in a direction away from the block 40 by magnetic repulsion to thereby move the restrictor head 36 of the member 34 out of conflicting relationship with the rod 28 and to allow free movement of the rod or shaft 28. Thus, the trigger may then be fully retracted, or the hammer may be cocked, so the weapon can be discharged. Accordingly, when a user wearing a ring, such as ring 46, grips the handle 29 so as to position such ring in proximity to the edge 29*a* of the handle grip, to thereby set up the proper magnetic repelling forces, the weapon may be fired. It is noted at this juncture of the description, however, that the edge 29*a* of the handle-grip frame 29 is preferably made of a non-magnetically attractable material so as not to interfere with the preferred movement of the member 34 in response to magnetic forces from the ring 46. If the magnetic ring means 46 is subsequently removed from proximity with the member 34, the resilient member 38 will return the member 34 to the preferred conflicting relationship.

Figure 2A:
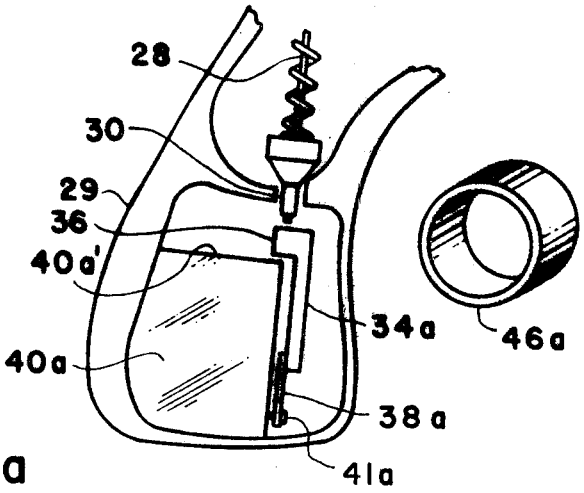
FIG. 2*a* illustrates an alternate form of the confronting member employed in the weapon shown in FIG. 2.

Referring now to FIG. 2*a*, an elevational view of a modified version of the embodiment illustrated in FIG. 2 and described hereinabove is shown. Only a portion of the revolver 20 is shown since the revolver is substantially identical to that as shown in FIG. 2. A shaft or rod 28 within the handle-grip frame 29 is biased by compression spring 26 against the hammer (not shown) and is slidable in a track 30 directing rod movement approximately along the length of the handle-grip frame 29 in response to hammer rotation. A restrictor head 36a is disposed on one end of the member 34a for providing a conflicting relationship with an end of the rod or shaft 28 so as to prevent cocking of the hammer, which prevents the trigger (not shown) from displacing the hammer sufficiently to release the hammer.

The member 34a is secured in the handle-grip frame 29 by means of a resilient member 38a. The resilient member 38a is secured to a block 40a, preferably of a non-magnetic material, by means of a pin 41a. The block 40a is contained within the handle-grip frame 29 and has a surface 40a' which acts as a backstop or support for the restrictor head 36a when a force is exerted thereon by means of the shaft or rod 28.

The operation of the alternate embodiment illustrated in FIG. 2a is substantially identical to that described hereinabove. Briefly, the magnetically actuable member 34a is deflected by the presence of a magnetic means 46a such as a ring containing a magnet therein, so as to remove the restrictor head 36a from a conflicting relationship with the shaft or rod 28. In this embodiment the magnetically-actuable member 34a is polarized so as to be attracted by the magnetic means 46a for deflection out of conflicting relationship to allow free movement of rod 28. In addition, when the magnetic ring 46a is removed from close proximity to the handle-grip frame 29 the member 34a returns to a conflicting relationship with rod or shaft 28 by means of the resilient member 38a returning to its neutral position.

Figure 3:
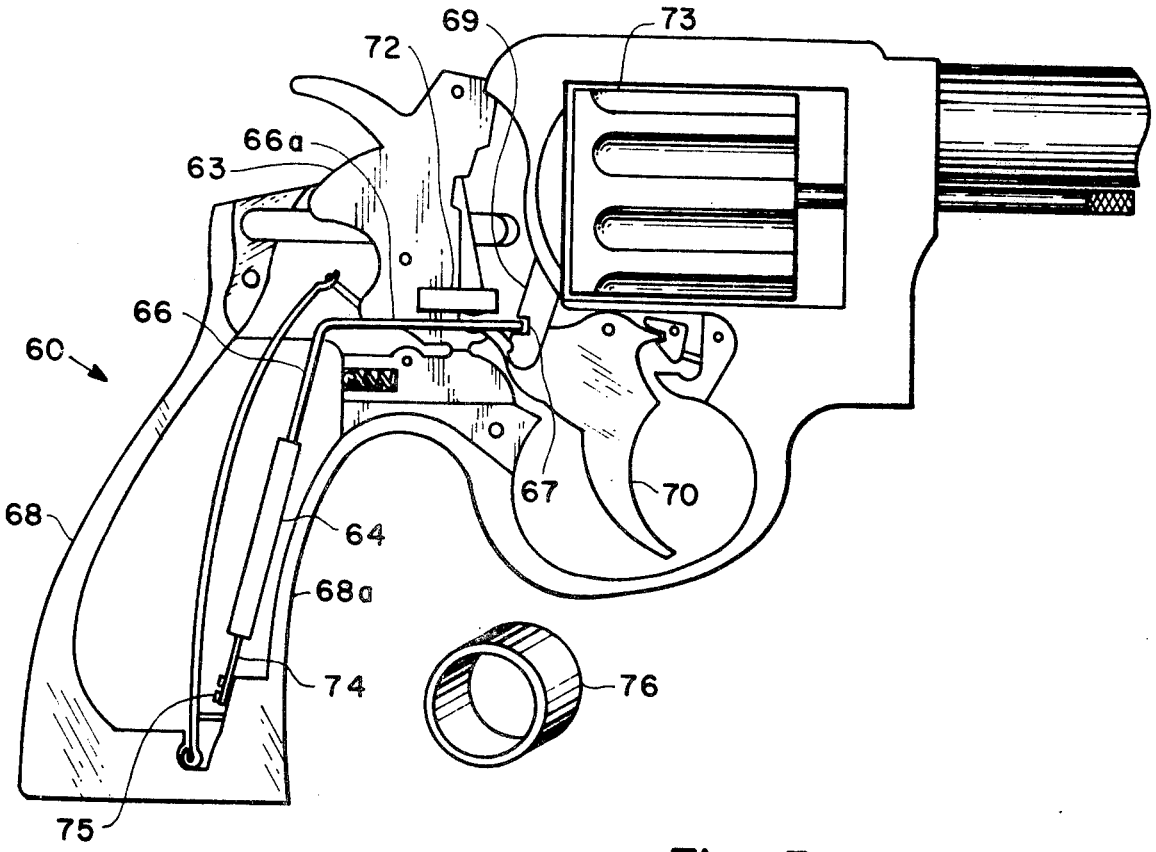
FIG. 3 illustrates another embodiment of the present invention employed in a revolver.

Referring now to FIG. 3, yet another embodiment of the present invention is illustrated in a revolver 60, which is substantially identical to a revolver described in my above-cited application Ser. No. 670,937, at FIG. 9 thereof. A magnetically actuable member 64 has an arm 66 thereof extending through handle-grip frame 68 of the weapon 60. A restrictor portion 66a of the arm 66 is disposed within a notch 67 in a cylinder rotation linkage member 69 for blocking movement of this linkage, which linkage is coupled to the trigger 70. A support member 72 within the revolver 60 is disposed in close proximity to the restrictor portion 66a of the arm 66 to reinforce the restrictor portion when engaged in notch 67 and when the linkage member 69 is moved or attempted to be moved in response to pressure applied to the trigger 70.

The magnetically-actuable member 64 is secured in the handle-grip frame 68 by means of a resilient member 74 secured to an edge 68a of the handle-grip frame 68 by means of a pin 75. The neutral position of the magnetically-actuable member 64, and of the resilient member 74, occurs when the extension portion 66a of the arm 66 is engaged in the notch 67 of the linkage 69. Thus, movement of the linkage 69 is inhibited when the magnetically-actuable member 64 is in the neutral position.

In normal operation, when pressure is applied to the trigger 70 the cylinder rotation linkage 69 is moved so as to engage projections (not shown) on an end of the cylinder 73 to thereby rotate the cylinder placing the next cartridge in a firing position. Simultaneously, in normal operation, movement of the trigger 70 allows the hammer 63 to rotate in a backward direction thereby cocking the weapon. When a magnetic means 76 is brought into close proximity with edge 68a of the handle-grip frame 68 the magnetically actuable member 64 is deflected (in a repelling mode of operation as illustrated in FIG. 3) so as to remove the restrictor portion 66a of the arm 66 from the notch 67 of the linkage 69. Accordingly, the trigger 70 may be employed to fire the weapon. When the magnetic means 76 is removed from close proximity with edge 68a of the handle-grip frame 68, the resilient member 74 returns the magnetically-actuable member 64 to a neutral position whereby portion 66a of the arm 66 again engages the notch 67 in the linkage 69. Accordingly, the safety apparatus of the present invention may be employed to inhibit operation of a firearm such as a revolver 60, but the revolver may be made operable by the presence of a magnet contained within the magnetic means 76, which may comprise a finger-worn ring by a user of the weapon.

Figure 3A:
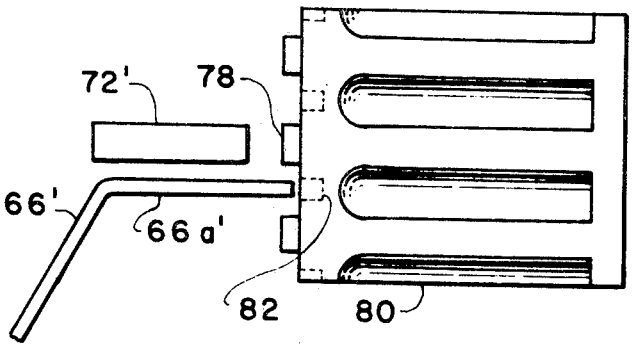
FIG. 3*a* illustrates an alternate form of the embodiment shown in FIG. 3.

Referring now to FIG. 3a, another version of the embodiment illustrated in FIG. 3 and described in detail hereinabove is shown. Briefly, a revolver cylinder 80 and only a portion of the embodiment of the present invention is shown, since the revolver in the version of this embodiment is substantially similar with that shown in FIG. 3. In this version a restrictor portion 66a' of arm 66' is disposed in the path of rotation of projections 78 on an end of the cylinder 80. A backstop or support member 72' reinforces the restrictor portion 66a' when pressure is applied such as from an attempted rotation of the cylinder 80 in response to pressure applied to the cylinder rotational linkage 69 (FIG. 3) as a function of pressure being applied to the trigger 70 (FIG. 3), which trigger is coupled to the linkage member or hand pressure applied directly to cylinder 80.

Alternatively, a notch or notches 82 (shown in phantom) may be formed in an end of the cylinder 80'. The restrictor portion 66a' engages within the notch 82 to thereby inhibit movement of the cylinder 80. The operation of this alternate embodiment is substantially identical to that described hereinabove.

Figure 4:
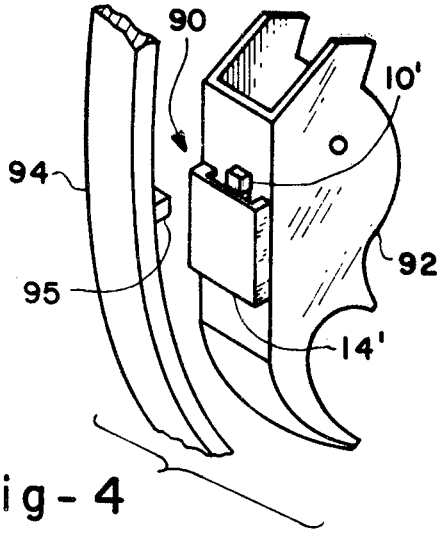
FIG. 4 illustrates yet another embodiment of this invention in the form of a trigger inhibiting mechanism.

Referring now to FIG. 4, yet another embodiment of the present invention is illustrated in the form of a safety apparatus 90 for inhibiting movement of a trigger 92. It is noted that a similar embodiment to that of this present invention is illustrated in FIG. 3 of my U.S. Pat. No. 3,978,604 which issued on Sept. 7, 1976, and described in detail therein, and is further amplified in my above-cited pending application. The safety apparatus 90 is substantially identical with the apparatus illustrated in FIG. 1 hereof and described in detail hereinabove. The housing 14' is attached to the side of the trigger 92, that normally faces a trigger protector 94. The magnetically-actuable member 10' is disposed for conflicting with a dimple or a projection 95 on the trigger protector 94. Thus, movement of the trigger 92 in a weapon employing this embodiment of the invention will be restricted by the magnetically-actuable member 10' engaging the notch 95. Magnetic forces applied in close proximity with housing 14' will deflect the member 10' to one side or the other so as to remove the member 10' from such conflicting relationship with the notch 95. Thus, the trigger may be moved sufficiently to fire the weapon employing this embodiment of the invention. When magnetic forces are removed from close proximity with trigger 92 and the housing 14' in particular, the member 10' returns to a conflicting relationship with the notch 95 by a resilient member (not shown) contained within the housing 14', the resilient member of this embodiment is identical to the resilient member 12 illustrated in FIG. 1 hereinabove.

Figure 5:
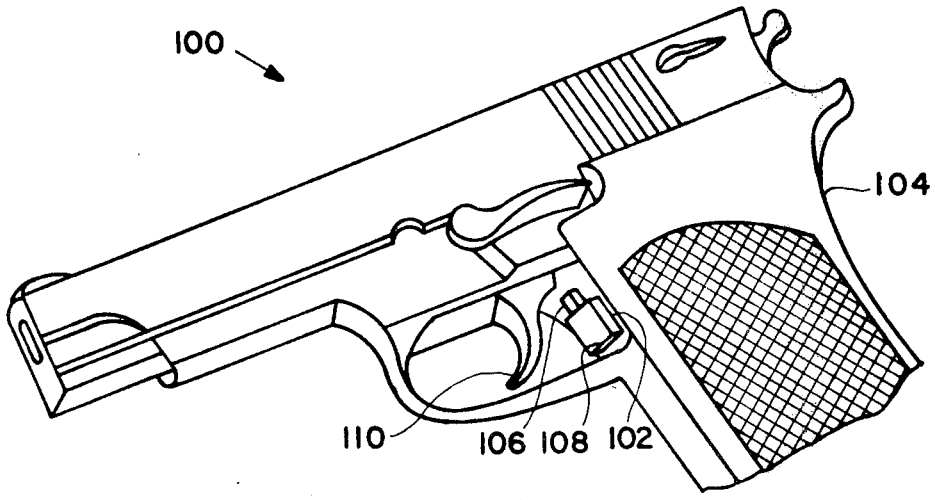
FIG. 5 illustrates yet another form of a trigger inhibiting mechanism.

Referring now to FIG. 5 a modified version of the embodiment illustrated in FIG. 1 is shown as being incorporated in a pistol 100. It is noted that this embodiment of the present invention is illustrated in FIGS. 1 and 8 of my U.S. Pat. No. 3,978,604 which issued on Sept. 7, 1976, and described therein, and as is further amplified in my above-cited pending application. Briefly, a safety apparatus 102 functioning in substantially the same manner as illustrated in FIG. 1 and discussed in detail hereinabove is mounted on the pistol handle 104 of the pistol 100. In the neutral position, as shown, a magnetically actuable member 106 extends from a nonferruginous housing 108 in conflicting relationship with a trigger 110 and blocks the movement of the trigger 110 preventing the pistol from being fired. If, for example, a magnetic force (now shown) is brought into close proximity with the member 106 thereby deflecting the magnetically actuable member, the member will be moved to one side or the other of the path of travel of the trigger 110. Accordingly, the trigger 110 is free to move sufficiently to cause the weapon to be fired. When the magnetic forces (not shown) are removed from close proximity with the member 106 the forces of a resilient arm (not shown) disposed within housing 108 returns the magnetically actuable member to a position in conflicting relationship with movement of the trigger 110.

Figure 5A:
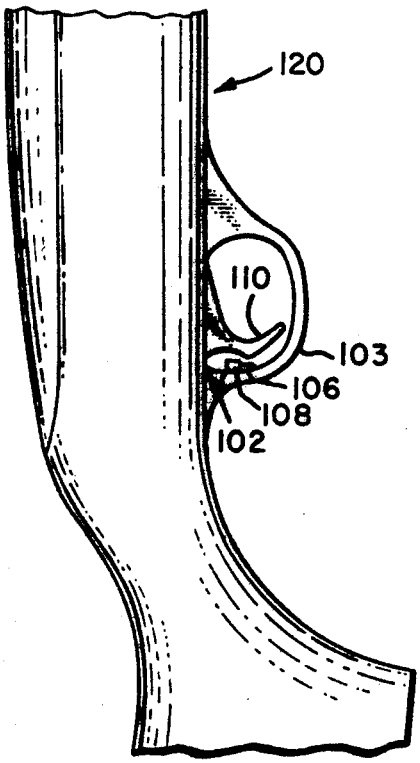
FIG. 5*a* is a side elevation view of a shoulder mountable weapon with the safety device attached to the trigger protector.

In FIG. 5*a* is depicted a modified version of the embodiment illustrated in FIG. 5, and is shown as being incorporated in a shoulder mountable weapon 120, such as a rifle or shotgun. Briefly, apparatus 102 functioning in substantially the same manner as illustrated in FIG. 1 is mounted on a trigger protector 103 of weapon 120. In its rest position the magnetically actuable member 106 extending from a nonferruginous housing 108 is in conflicting relationship with trigger 110 and blocks the movement of the trigger 110 preventing the weapon from being fired.

Figure 6:
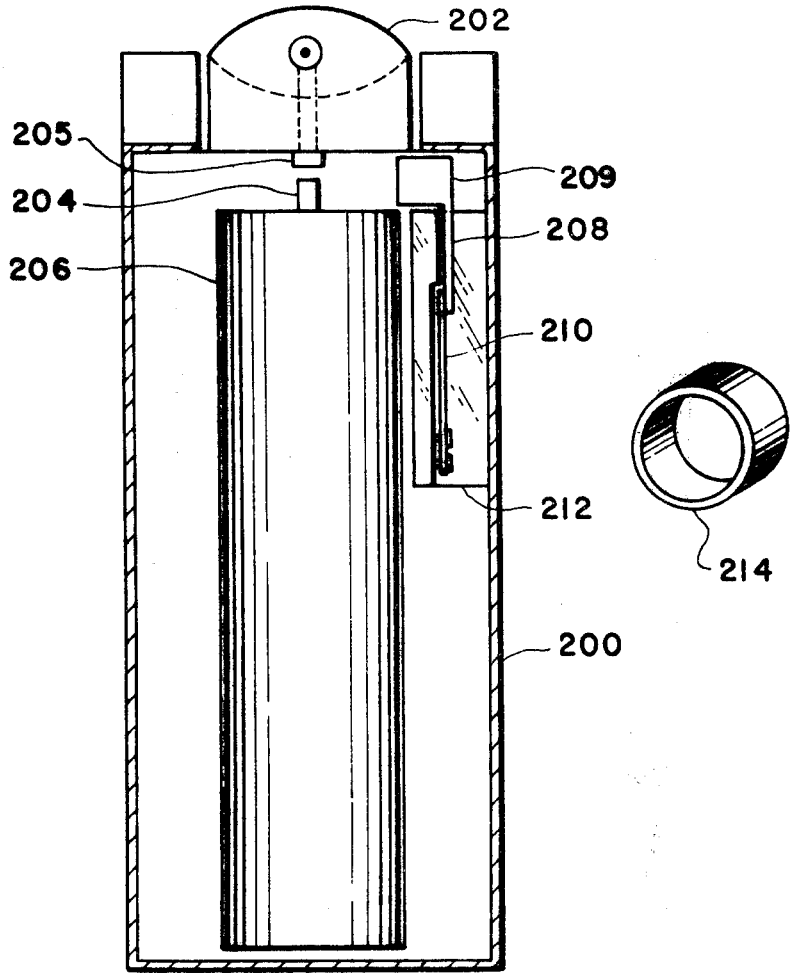
FIG. 6 illustrates the present invention employed in a touch-actuable pressurized container.

Referring now to FIG. 6, the present invention is illustrated as being employed in a touch-operable pressurized container 200. The container 200 preferably is constructed of a non-ferruginous (non-magnetic) material and, for example, may comprise any of the familiar pressurized containers such as a tear gas or similar type propellant can. The contents of a pressurized tank 206 disposed in container 200 is released therefrom by applying pressure to a button 202. The button 202, when pressed, engages a nozzle 204 of the tank 206, thereby allowing the vaporized pressure of liquid to escape from the tank 206.

In accordance with the embodiment of the present invention illustrated in FIG. 6, a magnetically actuable member 208 has a restictor head 209 formed on one end thereof, and is secured to a resilient member 210 at the other end thereof. The resilient member 210 is secured to a housing 212 attached to the container 200. The resilient member 210, such as a leaf spring, acts as a means for biasing the member 208 and the restrictor head 209 in particular in a conflicting relationship with the button 202. That is, the extension 205 of the button 202 will not be able to engage the nozzle 204 when the restictor head 209 is biased in a position as illustrated in the figure. It is noted that housing 212 may be attached to the tank 206 or other positions to maintain the member 208 in a conflicting relationship with the button 202.

If, for example, a magnetic means 214 if brought into close proximity with the container 200, and preferably within close proximity to the member 208, such member will move or deflect so as to remove the restrictor head 209 from a conflicting relationship with the button 202. In the particular embodiment illustrated in FIG. 6, it is preferable to have the polarization of the magnetic means 214 with respect to the magnetically actuable member 208 in such a manner so as to attract the member 208 in response to magnetic forces from the magnet 214. If the magnet 214 is removed from close proximity to the member 208, the forces of the resilient member 210 will return the member 208 and the restrictor head 209 in particular to a neutral position, which comprises the conflicting relationship position as illustrated in the drawing.

The foregoing provides a simple device which acts as a safety device in the use of a firearm or other touch-operable device. It is particularly useful to prevent unauthorized or accidental discharge of the firearm and container-operable devices. Also, the present invention eliminates the time required to remove the safety on a weapon so the officer may act more rapidly. Additionally, unauthorized operation is prevented for touch-operable devices such as pressurized containers, power tools, or the like, thereby reducing accidental injuries to children as well as adults.

The foregoing is considered to have shown and described preferred embodiments of this invention, it being understood that numerous modifications and changes in details of construction, combination, and arrangement can be resorted to by those skilled in the art without departing from the scope of the invention as defined in the appended claims. It is noted other embodiments include, but are not limited to, inhibiting triggers on power tools, inhibiting the opening caps of bottles, inhibiting opening lids of containers, or inhibiting the operation of switches and the like.

What is claimed is:

1. A safety apparatus for preventing the unauthorized operation of a weapon having a movable part, which apparatus comprises:

a spring having a first end secured to said weapon;

a magnetically actuable member disposed on the second end of said spring, said spring biasing said magnetically actuable member in a conflicting relationship with said part for blocking movement of said part; and magnetic means from without said weapon for overcoming the bias of said spring thereby deflecting said magnetically actuable member so that said part is free to move.

2. An apparatus as in claim 1 further characterized by said magnetic means being formed in the shape of a ring to be worn by the user of said weapon.

3. An apparatus as in claim 2 further characterized by said ring being operative to repel said magnetically actuable member.

4. An apparatus as in claim 2 further characterized by said ring being operative to attract said magnetically actuable member.

5. An apparatus as in claim 1 further characterized by said weapon comprising a pistol.

6. An apparatus as in claim 5 further characterized by said magnetic means being formed in the shape of a ring to be worn by the user of said pistol.

7. An apparatus as in claim 1 further characterized by said weapon being shoulder mountable.

8. An apparatus as in claim 1 further characterized by said weapon having a trigger and a cylinder for holding cartridges to be fired by said weapon and said part comprising a cylinder rotation linkage member operative in response to movement of said trigger.

9. An apparatus as in claim 8 further characterized by a first end of said magnetically actuable member being disposed on said spring and a second end thereof including an arm with a restrictor, said restrictor being disposed in a conflicting relationship with said cylinder rotation linkage for blocking movement of said cylinder rotation linkage thereby preventing rotation of said cylinder.

10. An apparatus as in claim 9 further characterized by said cylinder rotation linkage forming a mechanical coupling between said trigger and said cylinder and said linkage having a notch formed therein and said restrictor being disposed for engaging said notch.

11. An apparatus as in claim 9 further characterized by said cylinder having a plurality of projections on one end thereof, and said projections forming a part of said cylinder rotation linkage and said restrictor being disposed in a conflicting relationship with said projections for blocking movement of said linkage.

12. An apparatus as in claim 1 further characterized by said weapon having a trigger, a cylinder for holding cartridges to be fired by said weapon and the cylinder having a plurality of notches formed in one end thereof, and a cylinder rotation linkage forming a mechanical coupling between said trigger and said cylinder, and said magnetically actuable member having a first end thereof disposed on said spring and a second end of said member having an arm with a restrictor, said restrictor being disposed in a position for engaging said notches for blocking movement of said part.

13. An apparatus as in claim 1 further characterized by said weapon having a trigger and a trigger protector with a projection formed thereon, said magnetically actuable member being disposed on a portion of said trigger in a conflicting relationship with said projection, for blocking movement of said trigger.

14. An apparatus as in claim 1 further characterized by said weapon comprising a toy pistol.

* * * * *